US006779370B2

(12) United States Patent
Bellow, Jr. et al.

(10) Patent No.: US 6,779,370 B2
(45) Date of Patent: Aug. 24, 2004

(54) SECURITY DEVICE, METHOD OF MANUFACTURING THE SAME, AND METHOD OF OPERATING THE SAME

(75) Inventors: Stephen Lester Bellow, Jr., Laguna Niguel, CA (US); Rodger D. Thomason, Santa Monica, CA (US); William Patrick Conley, Thousand Oaks, CA (US); Lawrence G. Kurland, Jericho, NY (US); George C. Chen, Chandler, AZ (US)

(73) Assignee: Belkin Components, Compton, CA (US)

( * ) Notice: Subject to any disclaimer, the term of this patent is extended or adjusted under 35 U.S.C. 154(b) by 0 days.

(21) Appl. No.: 10/085,856

(22) Filed: Feb. 27, 2002

(65) Prior Publication Data

US 2003/0159476 A1 Aug. 28, 2003

(51) Int. Cl.[7] ..... E05B 73/00

(52) U.S. Cl. ..... 70/14; 70/58; 403/348; 411/553

(58) Field of Search ..... 70/14, 18, 57, 70/58, 427–430; 403/348–352; 411/549–551, 553

(56) References Cited

U.S. PATENT DOCUMENTS

| | | | |
|---|---|---|---|
| 69,700 | A | 10/1867 | Pratt |
| 146,715 | A | 1/1874 | Salzer |
| 164,992 | A | 6/1875 | Goldstein |
| 170,701 | A | 12/1875 | Bechmann |
| 285,074 | A | 9/1883 | Rhoades et al. |
| 505,299 | A | 9/1893 | Schneider |
| 606,734 | A | 7/1898 | Olmstead |
| 611,646 | A | 10/1898 | Parker |
| 711,889 | A | 10/1902 | Wormald |

(List continued on next page.)

FOREIGN PATENT DOCUMENTS

| | | |
|---|---|---|
| CA | 791364 | 8/1968 |
| DE | 2800980 | 7/1978 |
| FR | 877220 | 12/1942 |
| FR | 1026519 | 4/1953 |
| FR | 1085107 | 1/1955 |
| FR | 2636686 | 3/1990 |
| IT | 451949 | 10/1949 |
| NO | 14095 | 11/1904 |

*Primary Examiner*—Lloyd A. Gall
(74) *Attorney, Agent, or Firm*—Darby & Darby

(57) ABSTRACT

A security device secures an apparatus having a wall (1110) with a slot (1120). The security device includes first and second shafts. The shafts have arms (10) rotatable about their respective axis into and out of their respective unlocked positions. Each of the axes of the arms are different from each other. The shafts also have tangs (12) extending from the arms.

23 Claims, 15 Drawing Sheets

U.S. PATENT DOCUMENTS 786,842 A 4/1905 Robeson
881,364 A 3/1908 Wheeler
913,800 A 3/1909 Andersen et al.
925,302 A 6/1909 Cropp
934,928 A 9/1909 Michel
942,537 A 12/1909 Batdorf
961,250 A 6/1910 Nickum
965,316 A 7/1910 Muller
1,009,548 A 11/1911 Mize
1,022,474 A 4/1912 Good
1,050,276 A 1/1913 Johnson
1,101,450 A 6/1914 Kerry
1,105,544 A 7/1914 Berger-Hahnel
1,120,816 A 12/1914 Hyatt et al.
1,292,696 A 1/1919 Brickley
1,468,955 A 9/1923 Bresee
1,513,432 A 10/1924 Shaw
1,692,671 A 11/1928 Logg
1,713,602 A 5/1929 Heiden
1,728,065 A 9/1929 Komarcsevits
1,867,361 A 7/1932 Keil
1,904,225 A 4/1933 Hendrix
2,102,583 A 12/1937 Alberg
2,383,397 A 8/1945 Lofqwist
2,559,549 A 7/1951 Sevcik
2,561,029 A 7/1951 Mason
2,577,956 A 12/1951 Elsberg
2,660,084 A 11/1953 Newman
2,677,261 A 5/1954 Jacobi
3,130,571 A 4/1964 Neumann
3,136,017 A 6/1964 Preziosi
3,213,745 A 10/1965 Dwyer
3,486,158 A 12/1969 Soltysik, et al.
3,785,183 A 1/1974 Sander ..... 70/58
3,798,934 A 3/1974 Wright et al. ..... 70/59
3,826,510 A 7/1974 Halter ..... 70/18 X
3,836,704 A 9/1974 Coules ..... 174/138 D
3,859,826 A 1/1975 Singer et al. ..... 70/58
3,875,645 A 4/1975 Tucker et al. ..... 29/271
3,986,780 A 10/1976 Nivet ..... 403/353
4,007,613 A 2/1977 Gassaway ..... 70/58
4,028,913 A 6/1977 Falk ..... 70/58
4,263,833 A 4/1981 Loudin et al. ..... 411/41
4,300,371 A 11/1981 Herwick et al. ..... 70/58
4,444,571 A 4/1984 Matson ..... 55/16
4,471,980 A 9/1984 Hickman ..... 292/19
4,478,545 A 10/1984 Mizusawa et al. ..... 411/57
4,527,405 A 7/1985 Renick et al. ..... 70/14
4,616,490 A 10/1986 Robbins ..... 70/14
4,738,428 A 4/1988 Themistos et al. ..... 248/551
4,856,304 A 8/1989 Derman ..... 70/14
5,022,242 A 6/1991 Povilaitis ..... 70/14
D337,040 S 7/1993 Carl et al. ..... D8/331
D346,733 S 5/1994 Carl et al. ..... D8/343
D347,987 S 6/1994 Carl et al. ..... D8/343
5,327,752 A 7/1994 Myers et al. ..... 70/58
5,361,610 A 11/1994 Sanders ..... 70/14
5,370,488 A 12/1994 Sykes ..... 411/551
5,381,685 A 1/1995 Carl et al. ..... 70/58
5,390,514 A 2/1995 Harmon ..... 70/14
5,394,713 A 3/1995 Harmon ..... 70/58
5,400,622 A 3/1995 Harmon ..... 70/14
5,493,878 A 2/1996 Murray, Jr. et al. ..... 70/58
5,502,989 A 4/1996 Murray, Jr. et al. ..... 70/58
D370,621 S 6/1996 Themistos et al. ..... D8/343
5,687,592 A 11/1997 Penniman et al. ..... 70/14
5,692,400 A 12/1997 Bliven et al. ..... 70/58
5,787,739 A 8/1998 Derman ..... 70/58
5,791,171 A 8/1998 Kelley ..... 70/58
5,836,183 A 11/1998 Derman ..... 70/58
5,875,657 A 3/1999 Kelley ..... 70/18
5,913,907 A 6/1999 Lee ..... 70/58
5,983,679 A 11/1999 Reyes ..... 70/58
6,000,251 A 12/1999 Murray, Jr. et al. ..... 70/58
6,000,252 A 12/1999 Murray, Jr. et al. ..... 70/58
6,006,557 A 12/1999 Carl et al. ..... 70/58
6,038,891 A 3/2000 Zeren et al. ..... 70/58
6,058,744 A 5/2000 Ling ..... 70/28
6,081,974 A 7/2000 McDaid ..... 411/400 X
6,112,561 A 9/2000 Carl ..... 70/58
6,112,562 A 9/2000 Murray, Jr. et al. ..... 70/58
6,155,088 A 12/2000 Murray, Jr. et al. ..... 70/58
6,170,304 B1 1/2001 Ohta ..... 70/14
6,173,591 B1 1/2001 Derman ..... 70/58
6,199,413 B1 3/2001 McDaid et al. ..... 70/58
6,205,824 B1 3/2001 Miao ..... 70/58
6,212,918 B1 4/2001 Kravtin ..... 70/14
6,212,922 B1 4/2001 Miao ..... 70/58
6,227,017 B1 5/2001 Igelmund ..... 70/58
6,244,080 B1 6/2001 Sakurai ..... 70/14
6,257,029 B1 7/2001 Liao ..... 70/58
2003/0106349 A1 * 6/2003 Broadbridge et al. ..... 70/58

* cited by examiner

SECURITY DEVICE, METHOD OF MANUFACTURING THE SAME, AND METHOD OF OPERATING THE SAME

FIELD OF THE INVENTION

This invention relates to locks, in general, and to lock mechanisms to secure an apparatus having a wall with an aperture, in particular.

BACKGROUND OF THE INVENTION

A typical laptop computer has a Kensington® security slot located in a wall of a housing of the laptop computer. When used with a security device, the security slot provides a means of securing the laptop computer to an immovable object to prevent the theft of the laptop computer. Many security devices have been designed, and some even patented, for this purpose. The ideal lock mechanism of the security device securely and tightly engages the security slot. The lock mechanism should also be convenient to use and relatively compact.

Most lock mechanisms use a soft foam washer to compensate for different depths of the security slots in different laptop computers. These lock mechanisms, however, do not securely engage the security slots because the foam washer permits movement of the lock mechanisms relative to the security slots after the lock mechanisms are attached to the security slots. Such movement of the lock mechanism can be exploited to break the engagement of the lock mechanism to the security slot.

Furthermore, most lock mechanisms do not adjust for different security slot widths, but a PC Guardian® lock mechanism does adjust for such differences in width by using a pair of scissor-like arms that move laterally within the security slot. The lateral movement of the arms, however, requires a reduction in the cross-section of the arms, and the small cross-section of the arms reduces the strength of the arms. The PC Guardian lock mechanism also uses a soft foam washer to compensate for different security slot depths, which is another disadvantage.

Accordingly, a need exists for a security device that adjusts or compensates for different sizes of different security slots while maintaining a strong, secure, and tight engagement with the security slots.

BRIEF DESCRIPTION OF THE DRAWINGS

The invention will be better understood from a reading of the following detailed description, taken in conjunction with the accompanying figures in the drawings in which.

Figure 23:
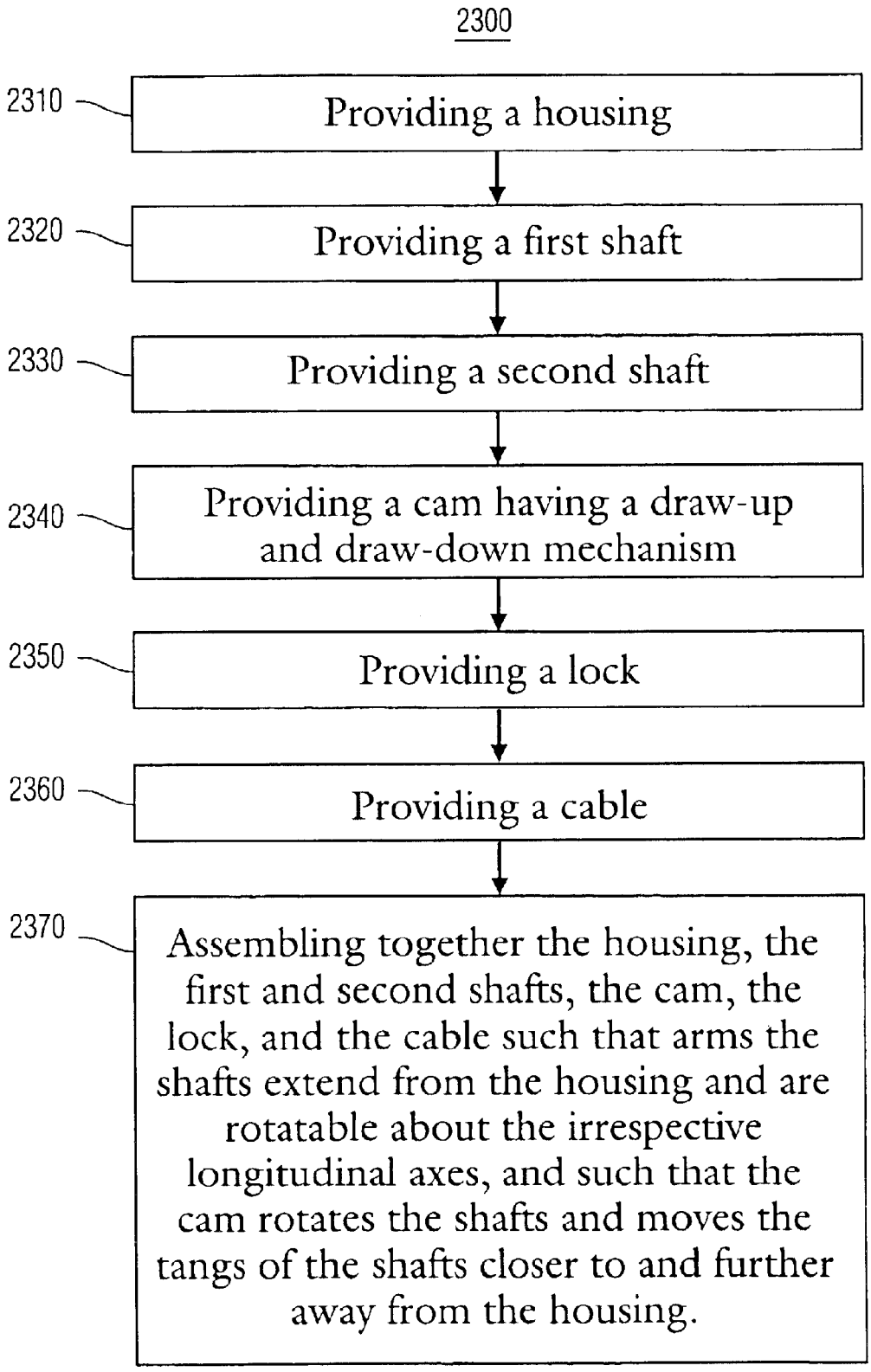
Figure 24:
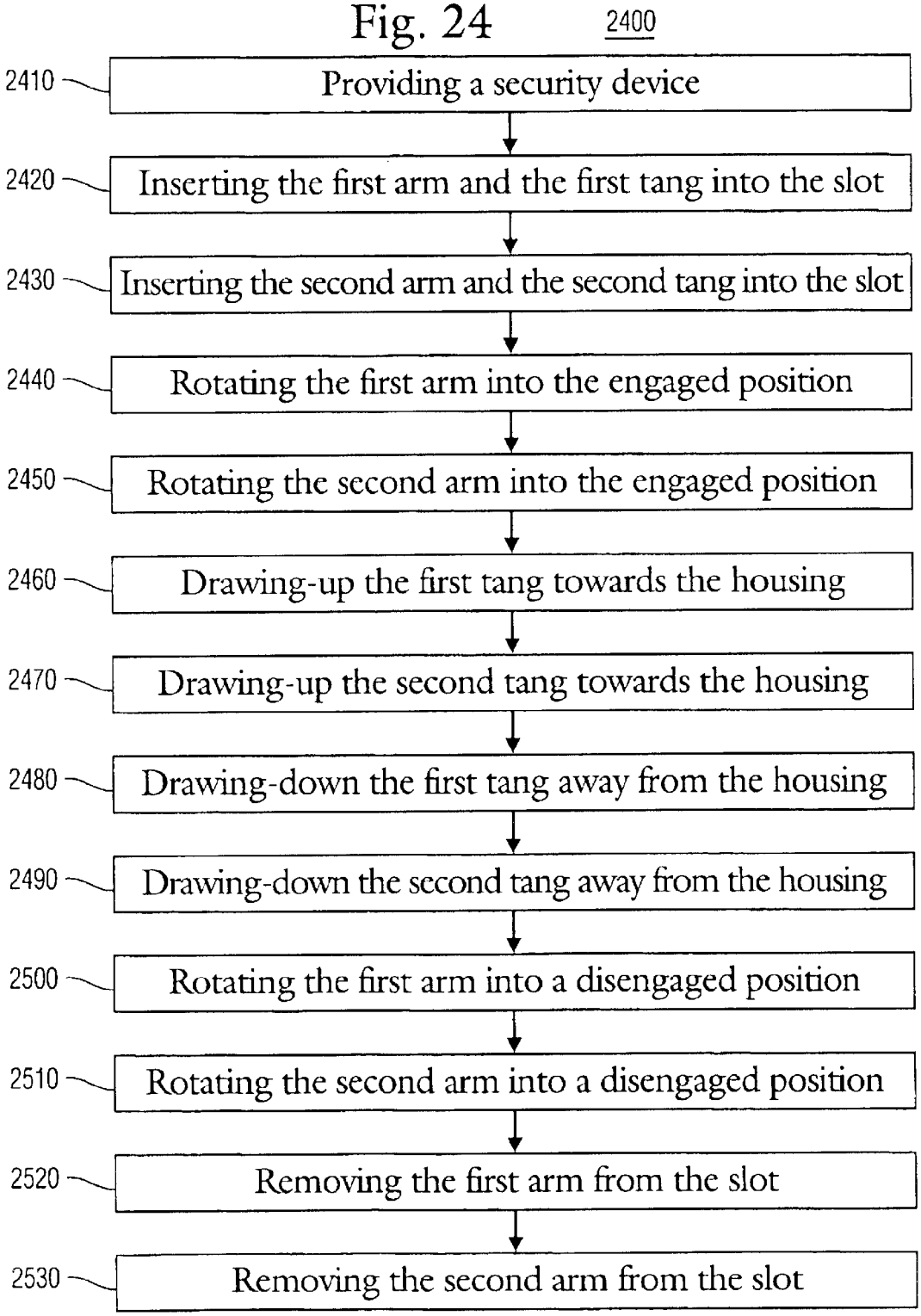

20 and relative to the security slot in accordance with an embodiment of the invention;

FIG. 23 illustrates a flow chart of a method of manufacturing a security device in accordance with an embodiment of the invention; and FIG. 24 illustrates a flow chart of a method of attaching a security device to a slot in a wall of an apparatus in accordance with an embodiment of the invention.

For simplicity and clarity of illustration, the drawing figures illustrate the general manner of construction, and descriptions and details of well-known features and techniques are omitted to avoid unnecessarily obscuring the invention. Additionally, elements in the drawing figures are not necessarily drawn to scale. For example, the dimensions of some of the elements in the figures may be exaggerated relative to other elements to help to improve understanding of embodiments of the present invention. Furthermore, the same reference numerals in different figures denote the same elements.

Furthermore, the terms first, second, third, fourth, and the like in the description and in the claims, if any, are used for distinguishing between similar elements and not necessarily for describing a sequential or chronological order. It is further understood that the terms so used are interchangeable under appropriate circumstances such that the embodiments of the invention described herein are, for example, capable of operation in other sequences than illustrated or otherwise described herein.

Moreover, the terms up, down, top, bottom, over, under, and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than illustrated or otherwise described herein.

DESCRIPTION OF THE DRAWINGS

Figure 1:
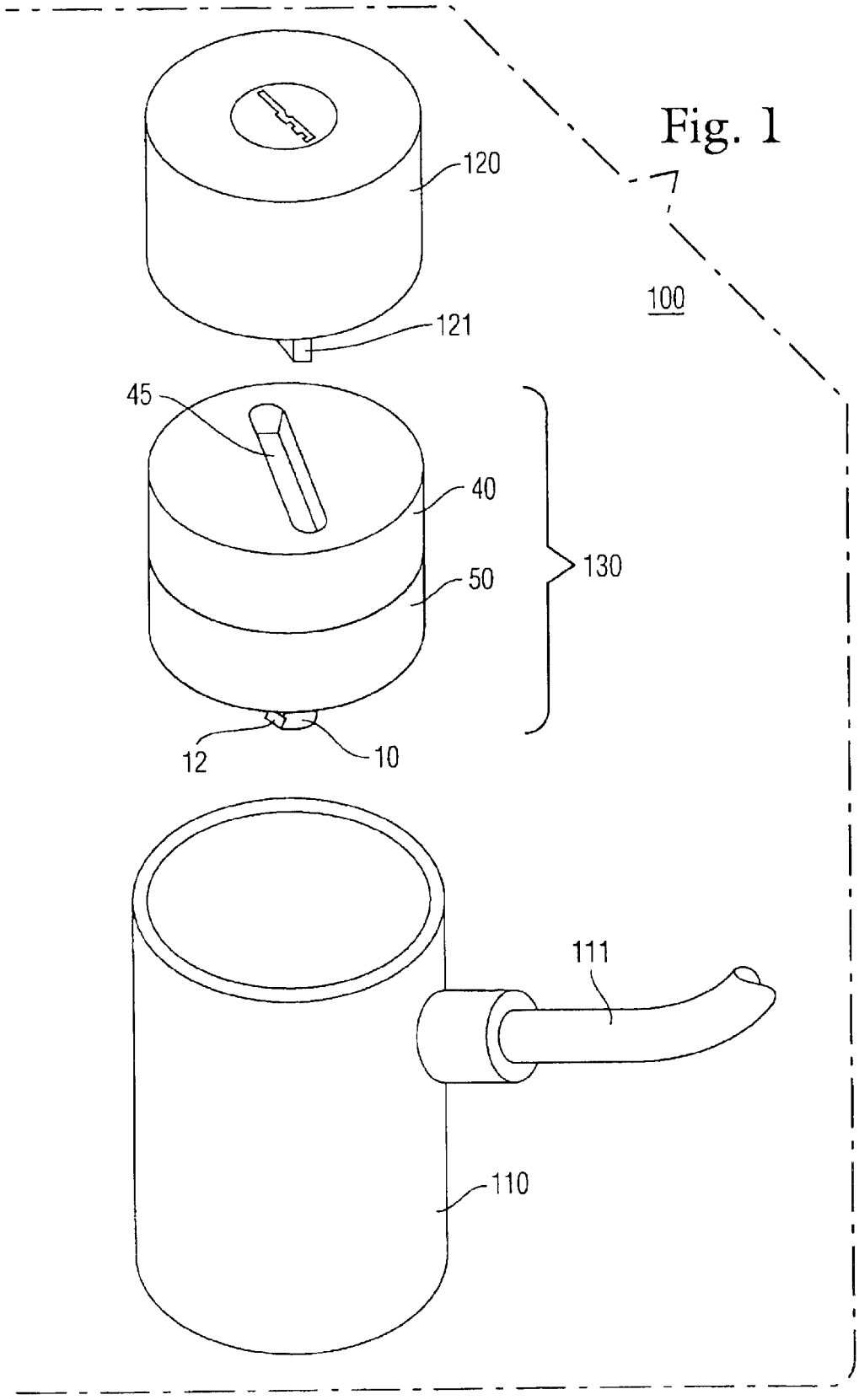
FIG. 1 illustrates an exploded, isometric view of a security device in accordance with an embodiment of the invention.

FIG. 1 illustrates an exploded, isometric view of a security device 100. As explained in more detail hereinafter, security device 100 is used to secure an apparatus having a wall and where the wall has a slot. Security device 100 comprises a housing 110, a cable 111, a lock 120, and a lock mechanism 130. Lock 120 and lock mechanism 130 are located adjacent to and can both fit within housing 110. As an example, lock 120 can be a key lock cylinder.

Lock mechanism 130 comprises a barrel cap 40 and a housing 50. Barrel cap 40 has a recess or aperture 45. Lock mechanism 130 also comprises a pair of shafts having arms 10 and tangs 12, but the view of security device 100 illustrated in FIG. 1 only depicts a single one of arms 10 and a single one of tangs 12. Cable 111 is coupled directly to housing 110 and is indirectly coupled to lock 120 and lock mechanism 130, including housing 50.

A portion of lock 120 can be rotated to move portions of lock mechanism 130. More specifically, lock 120 comprises a protrusion 121 that is configured to fit within aperture 45 of barrel cap 40 such that the rotation of protrusion 121 rotates barrel cap 40 to actuate the shafts of lock mechanism 130, as explained in more detail hereinafter. Lock 120 can also be immobilized or fixed in place to prevent protrusion 121 of lock mechanism 130, barrel cap 40, and the shafts of the lock mechanism 130 from moving.

Figure 2:
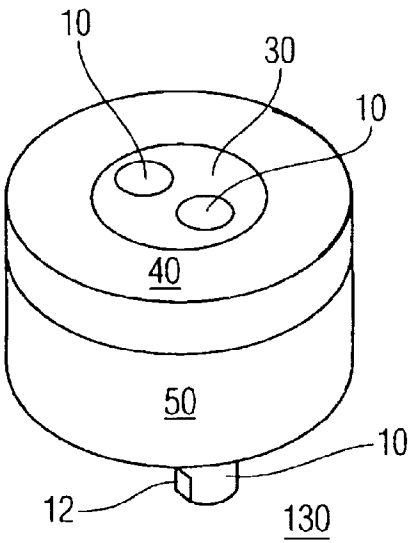
FIG. 2 illustrates a cut-away, isometric view of a lock mechanism of the security device in FIG. 1 in accordance with an embodiment of the invention.

FIG. 2 illustrates a cut-away, isometric view of lock mechanism 130 in security device 100 (FIG. 1). FIG. 2 illustrates the compact nature of lock mechanism 130. A top portion of barrel cap 40 is cut away for illustration purposes to expose some of the internal components of lock mechanism 130.

Figure 3:
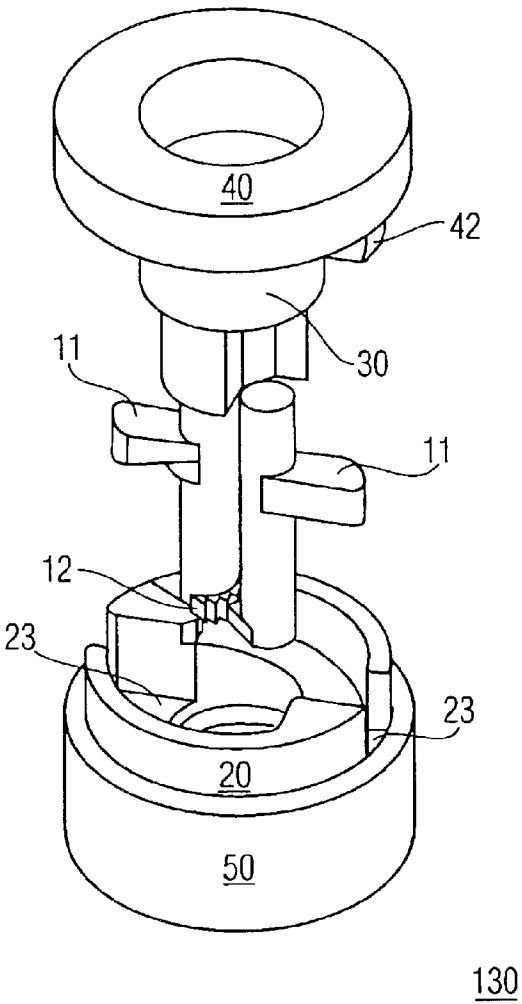
FIG. 3 illustrates an exploded, cut-away, isometric view of the lock mechanism in an unlocked or disengaged position in accordance with an embodiment of the invention.
Figure 4:
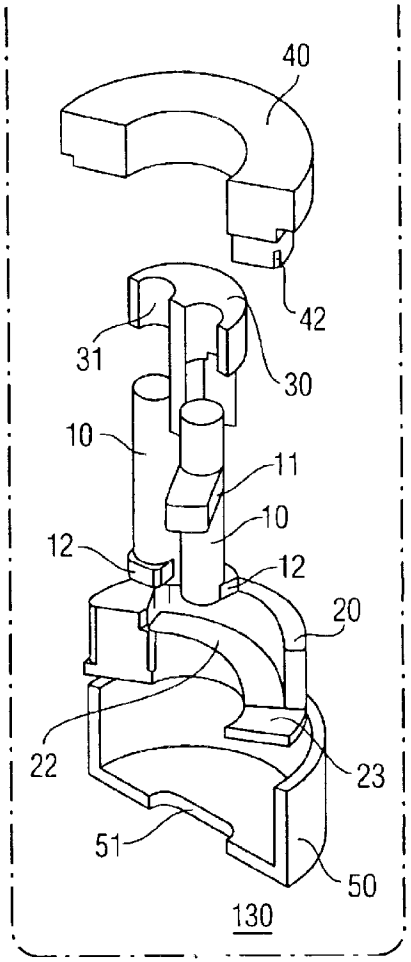
FIG. 4 illustrates a different exploded, cut-away, isometric view of the lock mechanism in a locked or engaged position in accordance with an embodiment of the invention.
Figure 7:
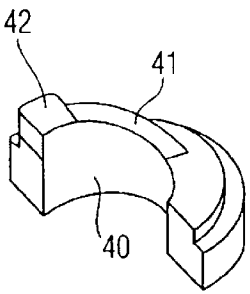
FIG. 7 illustrates a cut-away, isometric view of a barrel cap of the lock mechanism in accordance with an embodiment of the invention.
Figure 5:
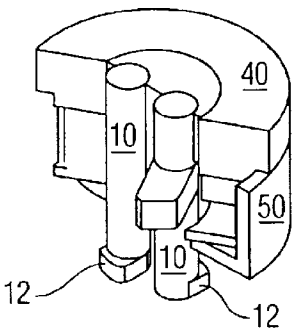
FIG. 5 illustrates a cut-away, isometric view of the lock mechanism in the locked or engaged position of FIG. 4 in accordance with an embodiment of the invention.
Figure 8:
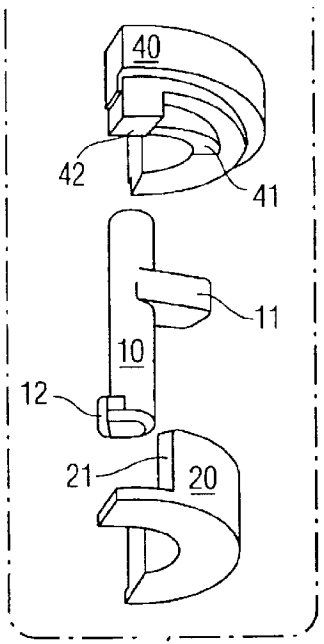
FIG. 8 illustrates an exploded, cut-away, isometric view of a portion of the lock mechanism in accordance with an embodiment of the invention.
Figure 6:
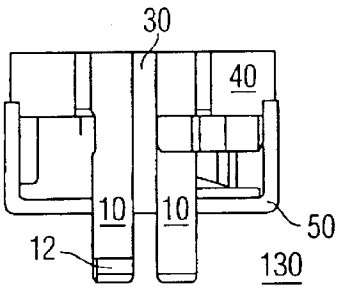
FIG. 6 illustrates a cut-away, planar view of the lock mechanism in the locked or engaged position of FIG. 4 in accordance with an embodiment of the invention.
Figure 9:
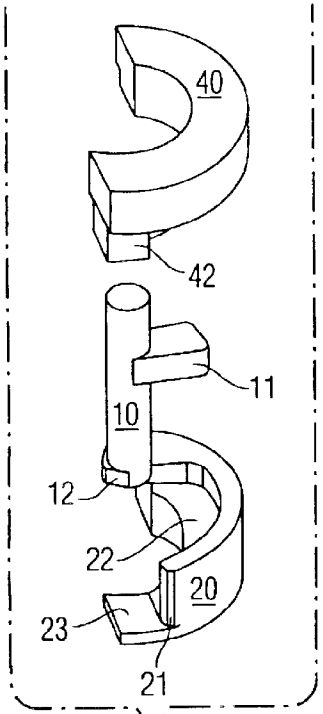
FIG. 9 illustrates a different exploded, cut-away, isometric view of the portion of the lock mechanism in FIG. 8 in accordance with an embodiment of the invention.

FIG. 3 illustrates an exploded, cut-away, isometric view of lock mechanism 130 in an unlocked or disengaged position, and FIGS. 4 through 7 illustrate various other views of the internal portions of lock mechanism 130. More specifically, FIG. 4 illustrates a different exploded, cut-away, isometric view of lock mechanism 130 in a locked or engaged position, and FIG. 5 illustrates a cut-away, isometric view of lock mechanism 130 in FIG. 4. Additionally, FIG. 6 illustrates a cut-away, planar view of lock mechanism 130 in FIG. 4, and FIG. 7 illustrates a cut-away, isometric view of a barrel cap 40 of lock mechanism 130. Furthermore, FIG. 8 illustrates an exploded, cut-away, isometric view of a portion of lock mechanism 130, and FIG. 9 illustrates a different exploded, cut-away, isometric view of the portion of lock mechanism 130 in FIG. 8.

FIGS. 3 through 9 illustrate the internal details of lock mechanism 130. As illustrated in FIGS. 3 through 9, lock mechanism 130 comprises a pair of shafts, a barrel 20, a spacer 30, barrel cap 40, and housing 50. Barrel 20 comprises walls 21 defining slots 23 therebetween and further comprises ramps 22. Spacer 30 comprises holes or bores 31, and barrel cap 40 comprises ramps 41 and protrusions 42. Housing 50 comprises a slot 51. Each of the pair of shafts can comprise one each of arms 10, extensions 11, and tangs 12, and the pair of shafts can be identical to each other. In the preferred embodiment, arms 10 are straight and are not curved or bent.

Arms 10 of the shafts extend from within barrel 20 and from within housing 50, through slot 51 of housing 50, to the outside of housing 50 and to the outside of housing 110 (FIG. 1). More specifically, each of arms 10 can extend from housing 50 and housing 110 (FIG. 1) along the respective longitudinal axes of each of arms 10. The two longitudinal axes are different from each other and are preferably parallel to each other. Tangs 12 are located outside of housing 50 and housing 110 (FIG. 1) and extend in different directions from the their respective ones of arms 10. The different directions of tangs 12 are non-parallel and non-co-linear with the longitudinal axes of arms 10.

Each of the two shafts and, thus, arms 10, extensions 11, and tangs 12 are illustrated in FIG. 3 in their respective disengaged or unlocked positions. In such positions, tangs 12 are approximately co-linear with each other, and the shafts can be inserted into the security slot and can also be removed from the security slot, as explained in more detail hereinafter.

Each of the two shafts and, thus, arms 10, extensions 11, and tangs 12 are illustrated in FIGS. 4, 5, and 6 in their respective engaged or locked positions. When arms 10 are located in the security slot and are in such positions, tangs 12 are approximately parallel with each other, and the shafts cannot be removed or are immovable from the security slot, as explained in more detail hereinafter.

Each of the shafts and, thus, each of arms 10, extensions 11, and tangs 12 are rotatable, relative to spacer 30, housing 50, and housing 110 (FIG. 1), about the longitudinal axes of arms 10 from their respective disengaged or unlocked positions to their respective engaged or locked positions. During such rotation, tangs 12 are also approximately parallel with each other.

When arms 10 are rotated about their respective longitudinal axes, tangs 12 can be simultaneously moved or rotated.

In the preferred embodiment, the shafts are rotated simultaneously in the same direction. Thus, both shafts can be simultaneously rotated clockwise to move the shafts from their respective disengaged positions to their respective engaged positions, and both shafts can be simultaneously rotated counter-clockwise to move the shafts from their respective engaged positions to their respective disengaged positions. Accordingly, in the preferred embodiment, both shafts are in their respective disengaged positions at the same time, and both shafts are in their respective engaged positions at the same time.

A portion of lock 120 (FIG. 1) rotates barrel cap 40, which rotates barrel 20 and which, in turn, rotates the shafts. Accordingly, barrel 20 and barrel cap 40, collectively, can be referred to as a cam, which is located adjacent to the shafts, spacer 30, housing 50, and housing 110 (FIG. 1). Barrel 20 and barrel cap 40 are coupled together and rotate together within and relative to spacer 30, housing 50, and housing 110 (FIG. 1). Protrusions 42 of barrel cap 40 extend at least partially into slots 23 of barrel 20 to providing the coupling between barrel 20 and barrel cap 40. As an example, aperture 45 (FIG. 1) in barrel cap 40 can provide the coupling between barrel 20 and lock 120 (FIG. 1).

The cam, or barrel 20 and barrel cap 40, can rotate each of the shafts by less than one hundred-eighty degrees about the axes of the shafts. In the preferred embodiment, the cam simultaneously rotates each of the shafts by only approximately ninety degrees to move the shafts from their disengaged position to their engaged position.

Spacer 30 and housing 50 support and constrain the motion of the shafts. In the preferred embodiment, spacer 30, in combination with housing 50, are designed to limit axial rotation of each of the shafts to ninety degrees and to limit axial translation of each of arms 10 for the draw-up and draw-down function (explained in more detailed hereinafter) to a predetermined amount. Spacer 30 is coupled to housing 50 via slot 51 of housing 50 and preferably remains stationary relative to housing 50 during operation of the security device.

After the shafts are rotated, the shafts are translated along their respective longitudinal axes, and consequently, arms 10 and tangs 12 are drawn upward into housing 50 and housing 110 (FIG. 1) to adjust or compensate for different depths of the security slots or different thicknesses of the walls defining the security slots. Drawing arms 10 and tangs 12 upward moves security device 100 (FIG. 1), including housing 50 and housing 110, tightly against the wall of the apparatus in which the security slot is located. The shafts extend out of housing 50 and housing 110 (FIG. 1) the furthest when the shafts are in their disengaged or unlocked positions, and the shafts extend out of housing 50 and housing 110 the least when the shafts are in their engaged or locked positions.

Arms 10 are preferably sized to fit the security slot with minimal clearance such that drawing tangs 12 upwards towards housing 50 and housing 110 (FIG. 1) produces the tight or rigid connection between the security device and the wall of the apparatus. This preferred design approach of the shafts eliminates the need to separately adjust for different lengths and widths of different security slots. Tangs 12 are preferably large enough to provide a strong overlapping engagement with the walls of the apparatus while remaining within the entire allowable size tolerance of the security slot. In the preferred embodiment, housing 50 and/or housing 110 (FIG. 1) is put into strong frictional contact with the wall of the apparatus to provide a stable and secure lock engagement with the security slot.

Ramps 22 of barrel 20 can provide the draw-up function briefly described above, and ramps 41 of barrel cap 40 can provide the opposite draw-down function briefly described above. Accordingly, barrel 20 can also be referred to as a draw-up mechanism, and barrel cap 40 can also be referred to as a draw-down mechanism. The draw-up and draw-down mechanisms are located adjacent to the shafts, spacer 30, housing 50, and housing 110 (FIG. 1).

Viewed from a different perspective, the cam, which comprises barrel 20 and barrel cap 40, can also be considered to include a draw-up mechanism and a draw-down mechanism. As indicated earlier, lock 120 (FIG. 1) rotates barrel cap 40, which rotates barrel 20, which rotates the shafts and also draws the shafts up and down. Accordingly, the cam can provide the rotational and translational movements of the shafts, where the rotational movement occurs about the longitudinal axis of arms 10 of the shafts and where the translational movements occurs along the longitudinal axes of arms 10 of the shafts.

In the preferred embodiment, the rotation of arms 10 about the respective longitudinal axes of arms 10 does not include a simultaneous translation of arms 10 or tangs 12 along the respective longitudinal axes of arms 10. Thus, the draw-up mechanism moves tangs 12 closer to housing 50 and housing 110 (FIG. 1) preferably only after the cam finishes the rotation of the shafts, and the shafts remain devoid of rotation about their respective axes while the draw-up mechanism moves tangs 12 closer to housing 50 and housing 110 (FIG. 1). In a different embodiment, however, the rotation and translation, or portions thereof, of arms 10 can occur simultaneously with each other.

FIGS. 10 through 22 illustrate various view of at least one of arms 10 moving from the disengaged or unlocked position to the engaged or locked position and from the engaged or locked position to the drawn-up position. In FIGS. 10, 13, 14, 15, 17, 18, 19, 20, and 21, only one of arms 10 is illustrated.

Figure 10:
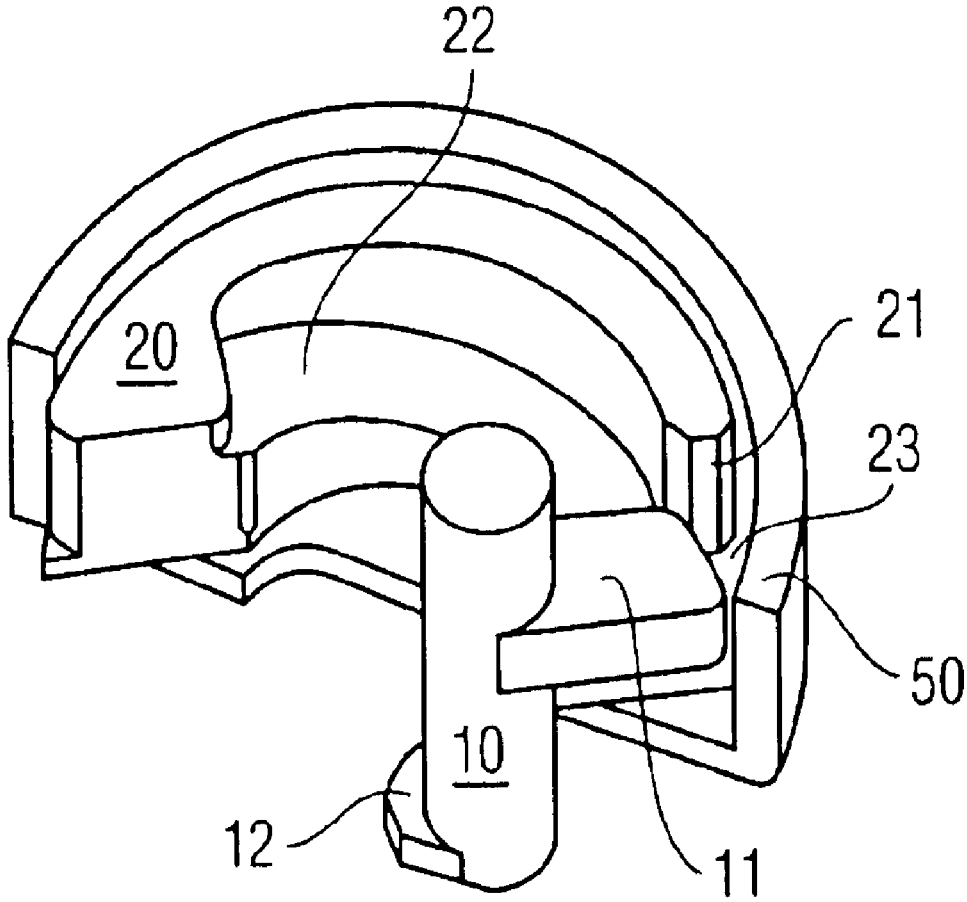
FIG. 10 illustrates a cut-away, isometric view of a portion of the lock mechanism in an unlocked or disengaged position in accordance with an embodiment of the invention.

FIG. 10 illustrates a cut-away, isometric view of a portion of lock mechanism 130 in an unlocked or disengaged position. In their disengaged positions of FIG. 10, arms 10 are fully extended and are positioned so as not to engage the security slot. When the shafts are in their disengaged positions, barrel 20 is rotated such that extensions 11 of the shafts protrude into slots 23 of barrel 20. The position of slots 23 of barrel 20 relative to slot 51 of housing 50 and bores 31 of spacer 30 forces arms 10 into a disengaged position. In this disengaged position, tangs 12 are co-linear and point towards each other to permit easy insertion and removal of the security device from the security slot.

Figure 11:
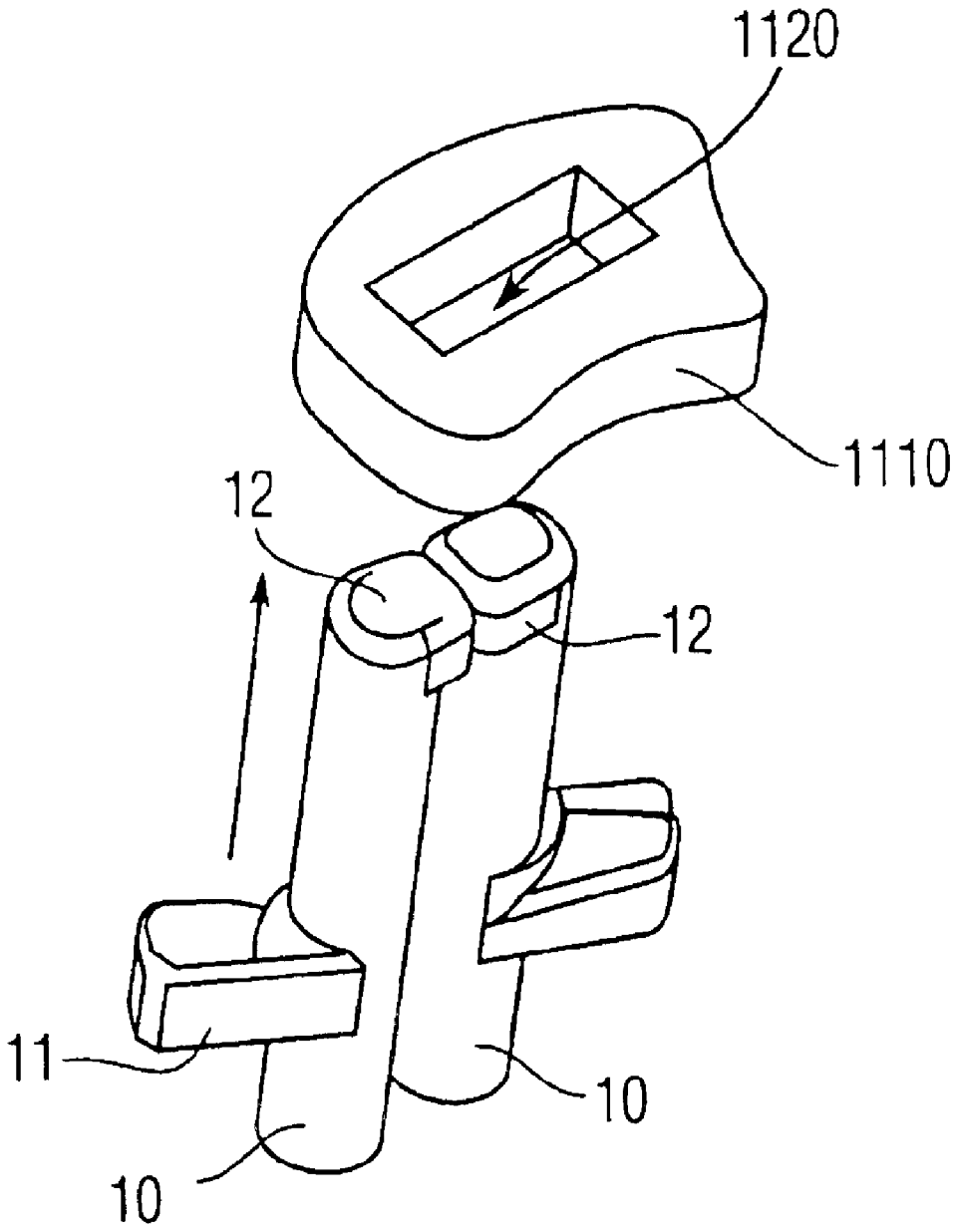
FIG. 11 illustrates an isometric view of a pair of shafts of the lock mechanism in the unlocked or disengaged position of FIG. 10 before being inserted into a slot of a wall of an apparatus in accordance with an embodiment of the invention.

FIG. 11 illustrates an isometric view of the pair of shafts of lock mechanism 130 in the unlocked or disengaged position of FIG. 10 before being inserted into a slot 1120 of a wall 1110 of an apparatus. As an example, the apparatus can be a laptop computer, and wall 1110 can be an exterior housing of the laptop computer. Furthermore, slot 1120 can be a security slot that is referred to as a "Kensington security slot" in the industry.

Figure 12:
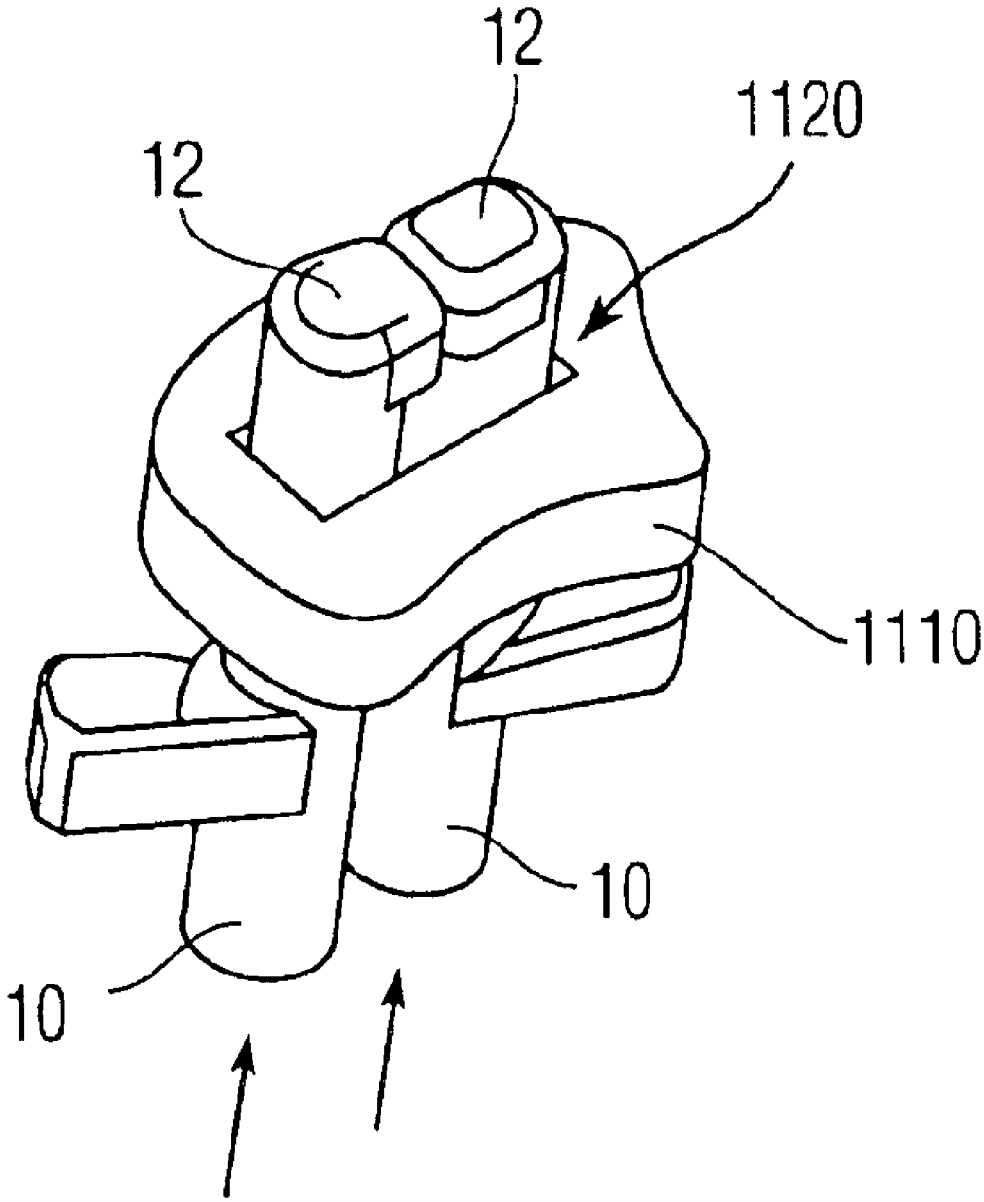
FIG. 12 illustrates an isometric view of the pair of shafts of the lock mechanism in the unlocked or disengaged position of FIG. 10 after being inserted into the slot of the wall of the apparatus in accordance with an embodiment of the invention.

FIG. 12 illustrates an isometric view of the shafts of lock mechanism 130 in the unlocked or disengaged position of FIG. 10 after being inserted into slot 1120 of wall 1110 of the apparatus. In the preferred embodiment, each of arms 10 of the shafts abut against at least two opposite edges or three contiguous or consecutive edges of slot 1120 when arms 10 are located in slot 1120. Tangs 12 of the shafts point in opposite directions towards each other and are co-linear with each other.

Figure 13:
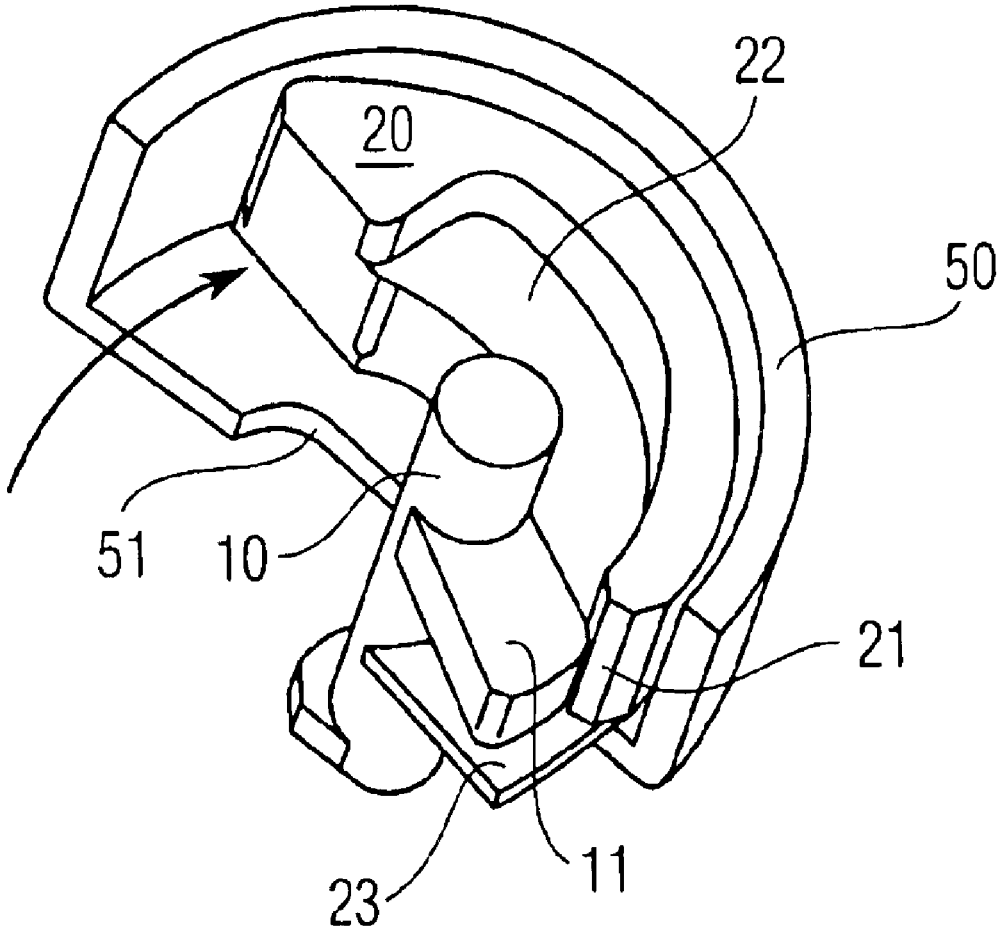
FIG. 13 illustrates a cut-away, isometric view of a portion of the lock mechanism during an initial stage of a transition from an unlocked or disengaged position to a locked or engaged position in accordance with an embodiment of the invention.

FIG. 13 illustrates a cut-away, isometric view of a portion of lock mechanism 130 during an initial stage of a transition from an unlocked or disengaged position to a locked or engaged position. FIG. 13 shows the beginning of the rotation of arms 10 after arms 10 are inserted into slot 1120 (FIG. 12). Lock 120 (FIG. 1) turns barrel cap 40 (FIG. 1), which causes barrel 20 to rotate. In the embodiment illustrated in FIG. 13, barrel 20 and barrel cap 40 (FIG. 1) rotate clockwise relative to spacer 30 (FIG. 3), housing 50, and housing 110 (FIG. 1). As barrel 20 rotates clockwise, walls 21 of slots 23 contact extensions 11 of arms 10, and the contact forces arms 10 to rotate clockwise about their longitudinal axes because of the constraint provided by slot 51 in housing 50 and spacer 30 (FIG. 3).

Figure 14:
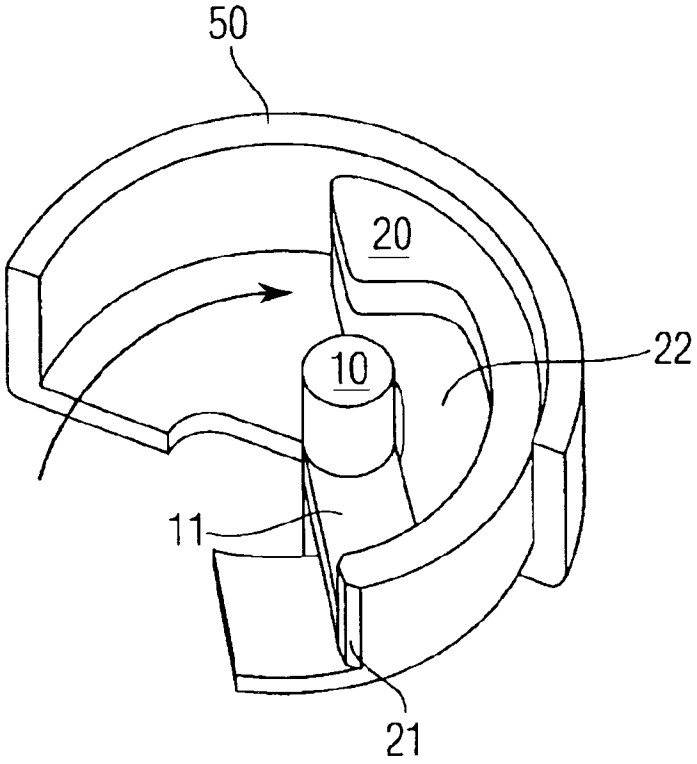
FIG. 14 illustrates a cut-away, isometric view of a portion of the lock mechanism during a subsequent stage of the transition from an unlocked or disengaged position to a locked or engaged position in accordance with an embodiment of the invention.
Figure 15:
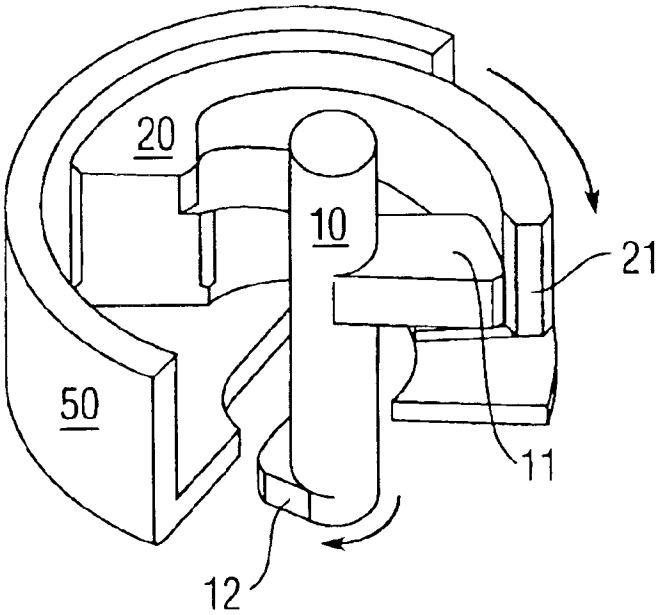
FIG. 15 illustrates a different cut-away, isometric view of the portion of the lock mechanism during the subsequent stage of FIG. 14 in accordance with an embodiment of the invention.

FIG. 14 illustrates a cut-away, isometric view of a portion of lock mechanism 130 during a subsequent stage of the transition from an unlocked or disengaged position to a locked or engaged position, and FIG. 15 illustrates a different cut-away, isometric view of the portion of the lock mechanism during the subsequent stage of FIG. 14. In FIGS. 14 and 15, barrel 20 continues to turn until walls 21 pass by extensions 11. In the illustrated embodiment, the geometry of extensions 11 is chosen to rotate arms 10 by ninety degrees, which forces tangs 12 of arms 10 into a locked or engaged position relative to slot 1120 (FIG. 12). Tangs 12 of arms 10 are each rotated ninety degrees so they can engage opposite sides of the security slot. In the preferred embodiment, rotation of barrel 20 beyond this point produces no further rotation of the shafts.

Figure 16:
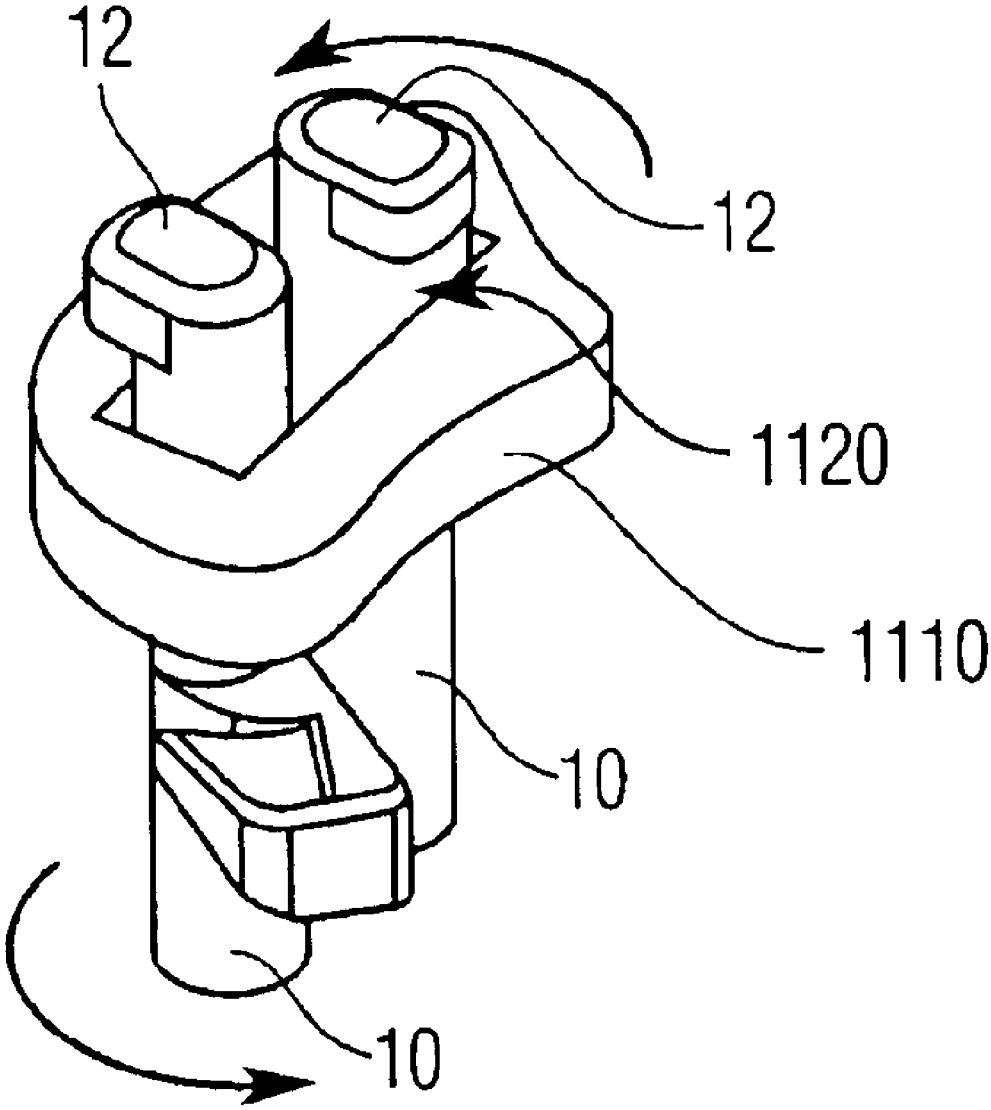
FIG. 16 illustrates an isometric view of the pair of shafts of the lock mechanism during the subsequent stage of FIG. 14 and relative to the security slot in accordance with an embodiment of the invention.

FIG. 16 illustrates an isometric view of the pair of shafts of lock mechanism 130 during the subsequent stage of FIGS. 14 and 15 and relative to slot 1120 in wall 1110. In the preferred embodiment, each of arms 10 of the shafts remain abutted against at least two opposite edges of slot 1120 when arms 10 are located in slot 1120. In their respective engaged positions, tangs 12 of the shafts point in opposite directions away from each other and are parallel with each other.

Figure 17:
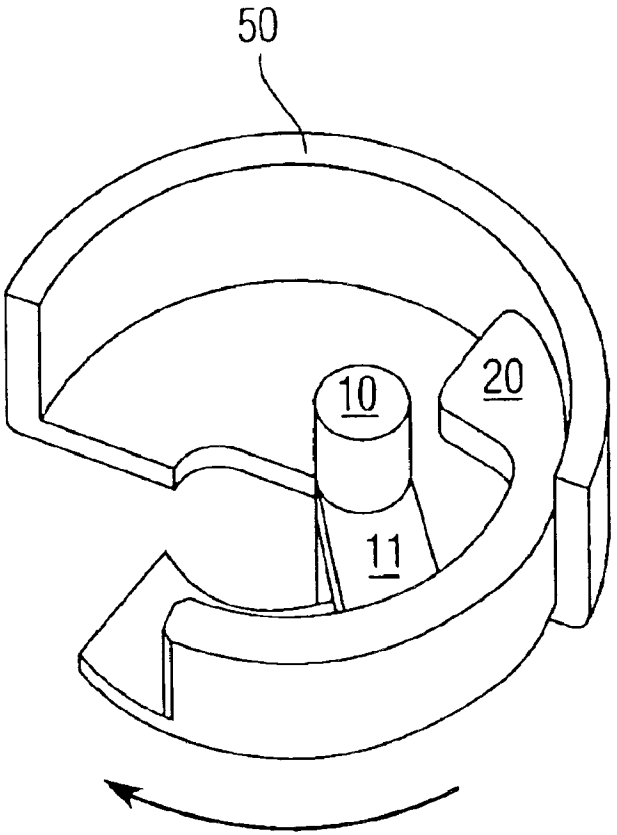
FIG. 17 illustrates a cut-away, isometric view of a portion of the lock mechanism during an initial stage of a transition from a locked or engaged position to a drawn-up position in accordance with an embodiment of the invention.
Figure 18:
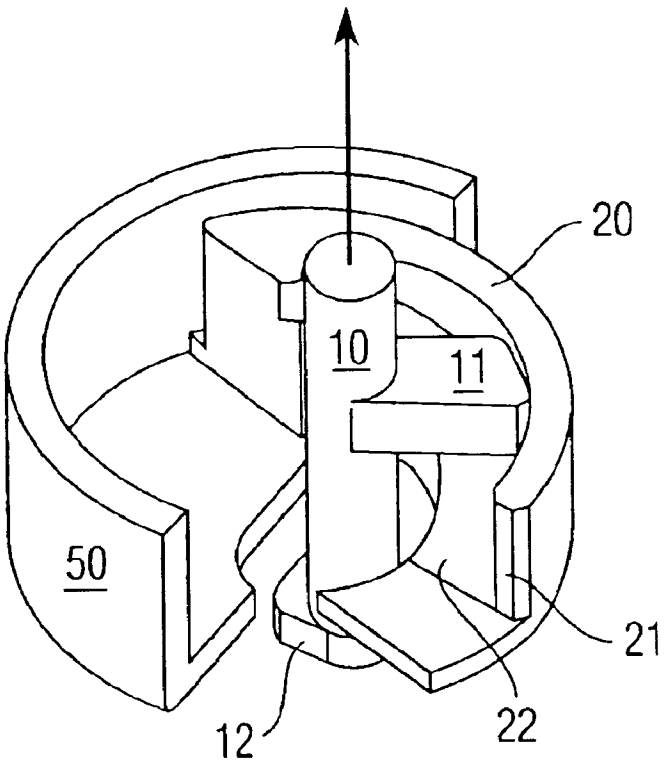
FIG. 18 illustrates a different cut-away, isometric view of the portion of the lock mechanism during the initial stage of FIG. 17 in accordance with an embodiment of the invention.

FIG. 17 illustrates a cut-away, isometric view of a portion of lock mechanism 130 during an initial stage of a transition from a locked or engaged position to a drawn-up position, and FIG. 18 illustrates a different cut-away, isometric view of the portion of lock mechanism 130 during the initial stage of FIG. 17. In FIG. 17 and 18, barrel 20 is further rotated clockwise relative to spacer 30 (FIG. 3), housing 50, and housing 110 (FIG. 1). This further rotation causes extensions 11 of arms 10 to engage ramps 22 of barrel 20. In the preferred embodiment, spacer 30 (FIG. 3) prevents arms 10 from rotating beyond ninety degrees during the further rotation of barrel 20. The engagement of ramps 22 by extensions 11 forces arms 10 upward. This engagement has the effect of drawing security device 100 (FIG. 1) in closer contact with wall 1110 (FIG. 16) and slot 1120 (FIG. 16).

Figure 19:
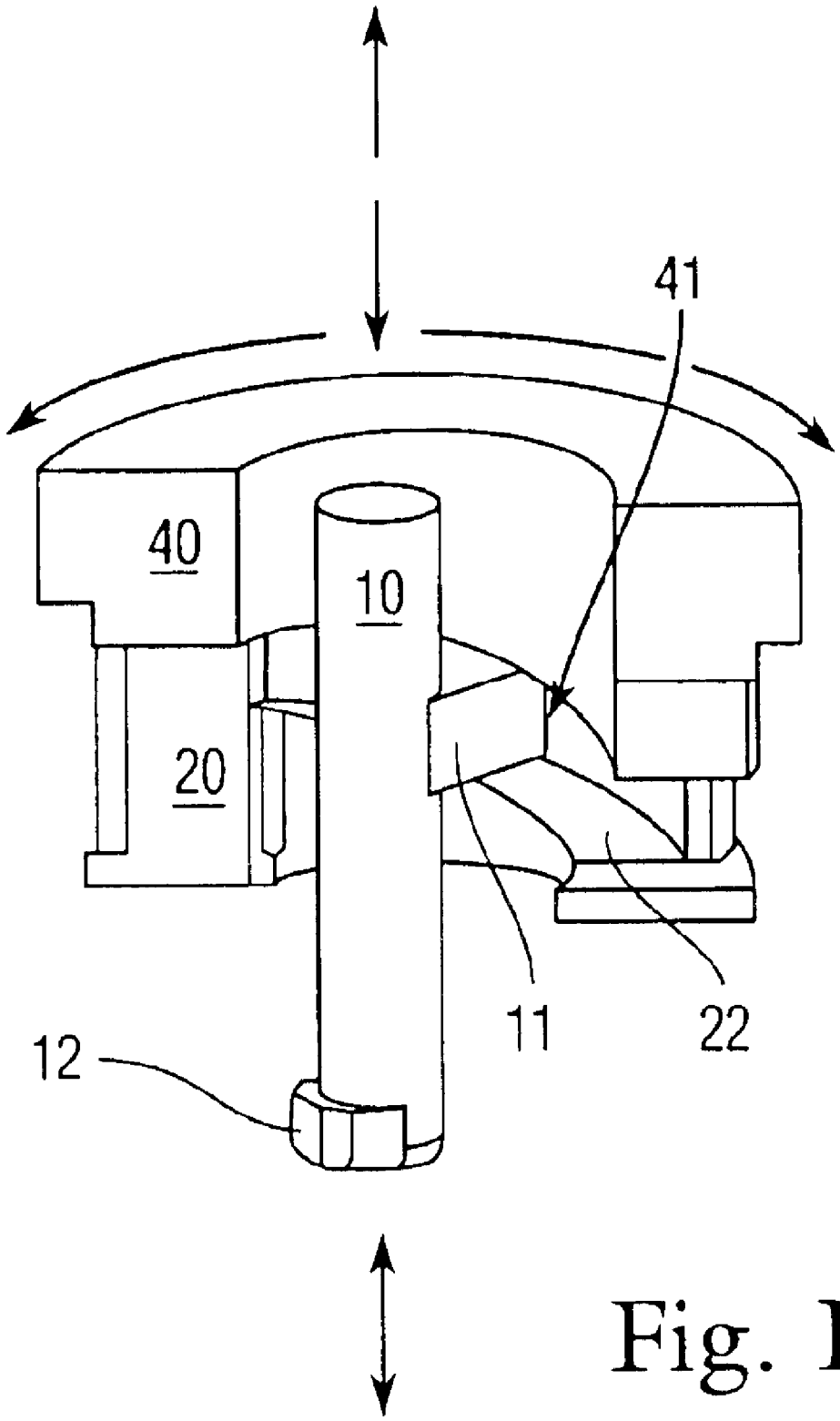
FIG. 19 illustrates a different cut-away, isometric view of a different portion of the lock mechanism during the initial stage of FIG. 17 in accordance with an embodiment of the invention.

FIG. 19 illustrates a different cut-away, isometric view of a different portion of lock mechanism 130 during the initial stage of FIGS. 17 and 18. Barrel cap 40 is illustrated in FIG. 19. Ramps 22 of barrel 20 continue to engage extensions 11 and draw arms 10 further upward.

The opposite effect is accomplished by ramps 41 of barrel cap 40 when barrel 20 and barrel cap 40 are rotated counter-clockwise. Ramps 41 push arms 10 downward, which loosens the attachment between security device 100 (FIG. 1) and slot 1120 (FIG. 16). Further rotation of barrel cap 40 and barrel 20 in the counter-clockwise direction rotates arms 10 in the same counter-clockwise direction and moves tangs 12 into the disengaged or unlocked position to permit removal of arms 10 and tangs 12 from slot 1120 (FIG. 11).

Figure 20:
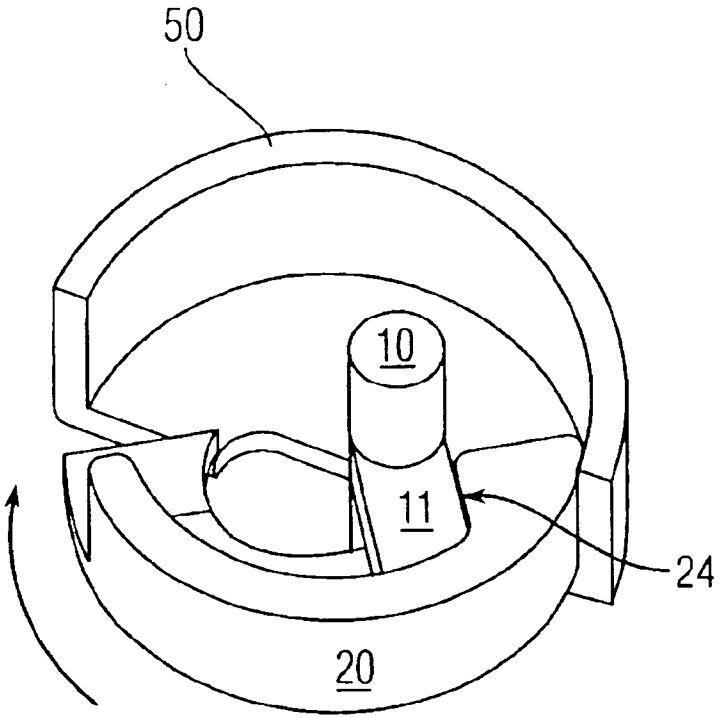
FIG. 20 illustrates a cut-away, isometric view of a portion of the lock mechanism during a subsequent stage of the transition from a locked or engaged position to a drawn-up position in accordance with an embodiment of the invention.
Figure 21:
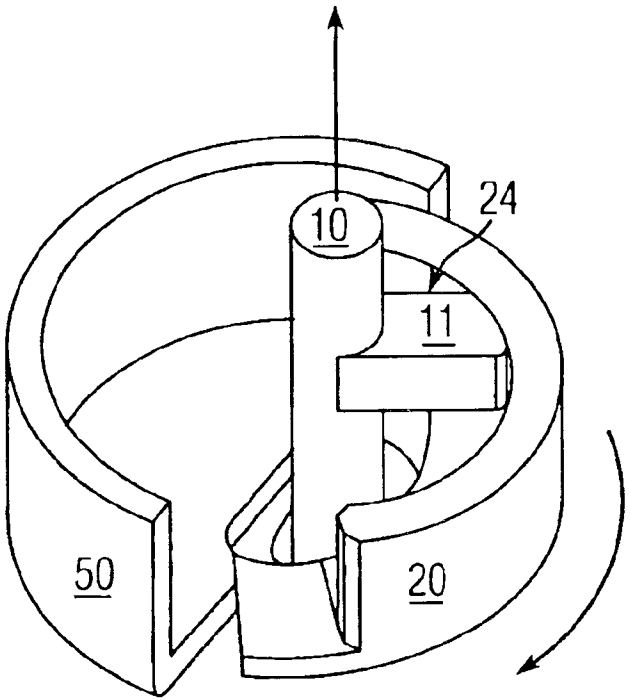
FIG. 21 illustrates a different cut-away, isometric view of the portion of the lock mechanism during the subsequent stage of FIG. 20 in accordance with an embodiment of the invention.

FIG. 20 illustrates a cut-away, isometric view of a portion of lock mechanism 130 during a subsequent stage of the transition from a locked or engaged position to a drawn-up position, and FIG. 21 illustrates a different cut-away, isometric view of the portion of lock mechanism 130 during the subsequent stage of FIG. 20. In FIGS. 20 and 21, barrel 20 is rotated to its maximum clockwise position, which corresponds to the maximum draw-up position of the shafts. Walls 24 of barrel 20 contact extensions 11 to prevent further rotation of barrel 20. Also in this position, barrel 20 has rotated one hundred-eighty degrees from the fully disengaged position of arms 10 illustrated in FIGS. 3 and 10 to the fully drawn-up position of arms 10 in FIGS. 4, 5, 6, 20, and 21.

Figure 22:
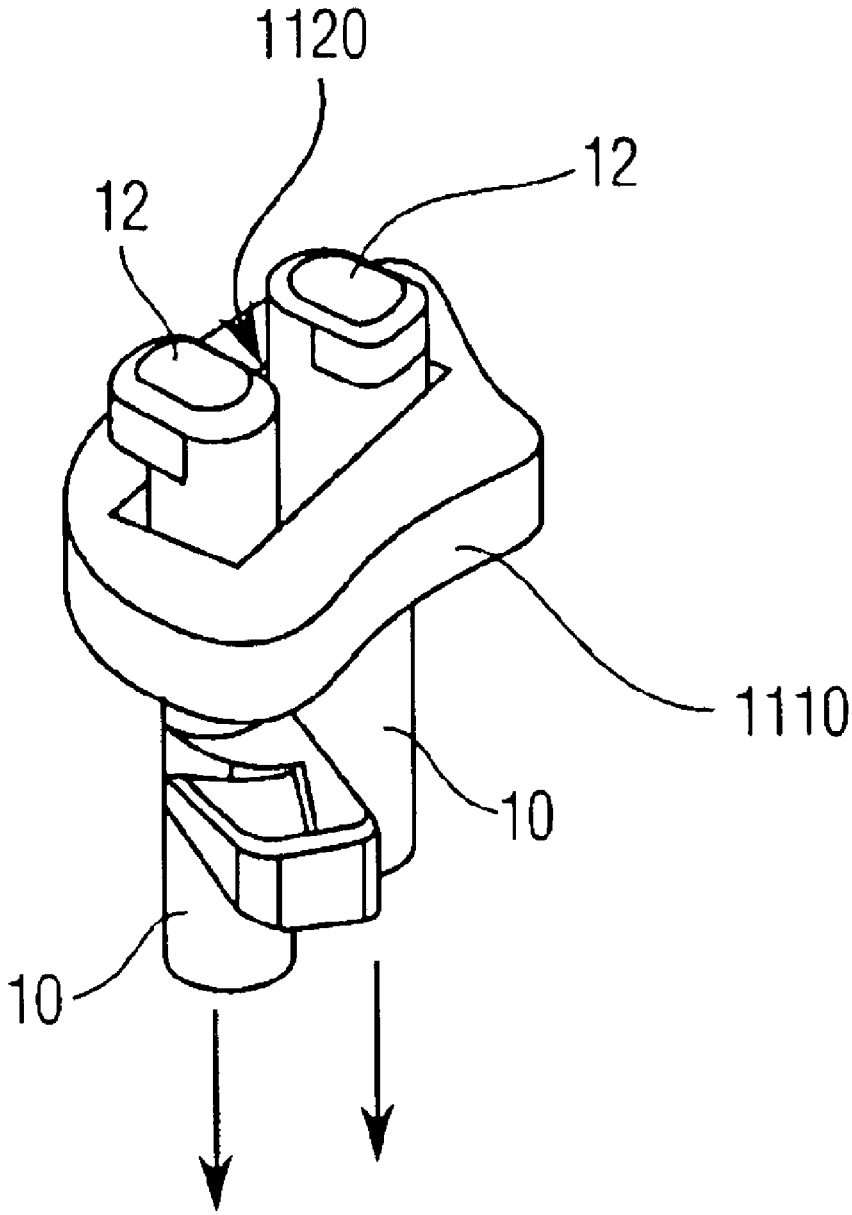
FIG. 22 illustrates an isometric view of the pair of shafts of the lock mechanism during the subsequent stage of FIG.

FIG. 22 illustrates an isometric view of the pair of shafts of lock mechanism 130 during the subsequent stage of FIGS. 20 and 21 relative to slot 1120. As illustrated in FIG. 22, one of tangs 12 of one of the shafts abuts against a first portion of wall 1110 that is adjacent to one edge of slot 1120 and preferably does not abut against a second portion of wall 1110 that is adjacent to an opposite edge of slot 1120. Similarly, the other one of tangs 12 of the other one of the shafts abuts against the second portion of wall 1110 and preferably does not abut against the first portion of wall 1110. In the preferred embodiment, each of arms 10 of the shafts continue to remain abutted against at least two opposite edges or three contiguous or consecutive edges of slot 1120 when arms 10 are located in slot 1120 to provide a secure attachment or engagement between the security device and slot 1120. Lock 120 locks the shafts in this position.

As indicated earlier, security device 100 (FIG. 1) is designed to tightly or securely attached to security slots of different sizes, including different depths. Consequently, the amount of axial translation of the shafts is preferably designed such that security device 100 (FIG. 1) will be in secure or tight contact or engagement with wall 1110 and slot 1120 of the apparatus before the position illustrated FIGS. 20 through 22 is reached, but after the position illustrated in FIGS. 14 through 16 is reached. In other words, security device 100 (FIG. 1) is designed such that this tight engagement will typically be achieved before lock 120, barrel cap 40, and barrel 20 are rotated one hundred eighty degrees from when the shafts were in their disengaged positions. The tight engagement with wall 1110 occurs when tangs 12 contact one side of wall 1110 and when housing 50 (FIG. 1) and/or housing 110 (FIG. 1) contact an opposite side of wall 1110. Accordingly, FIGS. 20 through 22 represent the thinnest expected wall in which slot 1120 is located, and only under such limited and rare conditions will lock 120, barrel cap 40, and barrel 20 be rotated one hundred eighty degrees.

In most cases, lock 120, barrel cap 40, and barrel 20 will be rotated somewhere between ninety and one hundred eighty degrees to achieve the tight engagement with wall 1110 and slot 1120. Lock 120 is designed such that the key for lock 120 can be withdrawn from lock 120 at any point after lock 120 is rotated ninety degrees from when the shafts were in their disengaged positions. After lock 120 is rotated at least ninety degrees and after the key is withdrawn from lock 120, lock 120 is no longer rotatable and is fixed in its current orientation, as are barrel cap 40, barrel 20, and the shafts, until the key is re-inserted into lock 120. Such locks are commonly and commercially available from a variety of sources.

FIG. 23 illustrates a flow chart 2300 of a method of manufacturing a security device. As an example, the security device of flow chart 2300 can be similar to security device 100 of FIG. 1. At a step 2310 of flow chart 2300 in FIG. 23, a housing is provided. As an example, the housing of step 2310 can be similar to housing 50 and/or housing 110 of FIG. 1. At a step 2320 of flow chart 2300 in FIG. 23, a shaft is provided, and at a step 2330, another shaft is provided. As an example, the shafts of steps 2320 and 2330 can be similar to the shafts of FIG. 3, each of which have one of arms 10, extensions 11, and tangs 12. At a step 2340 of flow chart 2300 in FIG. 23, a cam is provided. As an example, the cam of step 2340 can be similar to barrel 20 and barrel cap 40 of FIG. 3. Thus, the cam can also include a draw-up mechanism and a draw-down mechanism.

At a step 2350 of flow chart 2300 in FIG. 23, a lock is provided. As an example, the lock of step 2350 can be similar to lock 120 of FIG. 1. At a step 2360 of flow chart 2300 in FIG. 23, a cable is provided. As an example, the cable of step 2360 can be similar to cable 111 of FIG. 1. The sequence of steps 2310 through 2360 can be interchanged, as desired. At a step 2370 of flow chart 2300 in FIG. 23, the housing, shafts, cam, lock, and cable are assembled together such that the arms of the shafts extend from the housing and are rotatable about their respective longitudinal axes, such that the cam rotates the shafts, such that the draw-up mechanism of the cam moves the tangs of the shafts closer to the housing, such that the draw-down mechanism of the cam moves the tangs of the shafts further away from the housing, and such that the lock locks the shafts in a predetermined position.

FIG. 24 illustrates a flow chart 2400 of a method of attaching a security device to a slot in a wall of an apparatus. As an example, the security device of flow chart 2400 can be similar to security device 100 in FIG. 1, and the slot and the wall of flow chart 2400 can be similar to slot 1120 and wall 1110, respectively, in FIG. 11. At a step 2410 of flow chart 2400 in FIG. 24, a security device is provided.

To attach the security device to the slot, the following steps can be performed. For example, at a step 2420 of flow chart 2400, one of the arms and one of the tangs of one of the shafts of the security device is inserted into the slot, and at a step 2430 of flow chart 2400, the other one of the arms and the other one of the tangs of the other one of the shafts of the security device is inserted into the slot. Steps 2420 and 2430 can be performed sequentially or simultaneously with each other. Then, at a step 2440 of flow chart 2400, one of the arms of the shafts is rotated from a disengaged or unlocked position into an engaged or locked position, and at a step 2450 of flow chart 2400, the other one of the arms of the other one of the shafts is rotated from a disengaged or unlocked position into an engaged or locked position. Steps 2440 and 2450 can be performed sequentially or simultaneously with each other. Subsequently, at a step 2460 of flow chart 2400, one of the tangs of one of the shafts is drawn-up towards the housing of the security device, and at a step 2470 of flow chart 2400, the other one of the tangs of the other one of the shafts is drawn-up towards the housing of the security device. Steps 2460 and 2470 can be performed sequentially or simultaneously with each other. Furthermore, steps 2440 through 2470, or portions thereof, can be performed simultaneously with each other. Now, the security device is securely attached to the slot.

To remove the security device from the slot, the following steps can be performed. For example, at a step 2480 of flow chart 2400, one of the tangs of one of the shafts is drawn-down away from the housing, and at a step 2490 of flow chart 2400, the other one of the tangs of the other one of the shafts is drawn-down away from the housing. Steps 2480 and 2490 can be performed sequentially or simultaneously with each other. Next, at a step 2500 of flow chart 2400, one of the arms of one of the shafts is rotated from an engaged or locked position into a disengaged or unlocked position, and at a step 2510 of flow chart 2500, the other one of the arms of the other one of the shafts is rotated from an engaged or locked position into a disengaged or unlocked position. Steps 2500 and 2510 can be performed sequentially or simultaneously with each other. Furthermore, steps 2480 through 2510, or portions thereof, can be performed simultaneously with each other. Subsequently, at a step 2520 of flow chart 2500, one of the arms of one of the shafts is removed from the slot, and at step 2530 of flow chart 2500, the other one of the arms of the other one of the shafts is removed from the slot. Steps 2520 and 2530 can be performed sequentially or simultaneously with each other. Now, the security device is removed from the slot.

Therefore, an improved security device, a method of manufacturing the same, and a method of operating the same is provided to overcome the disadvantages of the prior art. The security device disclosed herein adjusts or compensates for different security slot sizes while maintaining a strong, secure, and tight engagement with the security slot.

Although the invention has been described with reference to specific embodiments, it will be understood by those skilled in the art that various changes may be made without departing from the spirit or scope of the invention. For instance, the numerous details set forth herein such as, for example, the specific shapes are provided to facilitate the understanding of the invention and are not provided to limit the scope of the invention. As another example, the cam can be rotated counter-clockwise, instead of clockwise, to rotate the shafts into the engaged position and to draw the shafts upward toward the housing, and the cam can be rotated clockwise, instead of counter-clockwise, to rotate the shafts into the disengaged position and to draw the shafts downward away from the housing. Furthermore, lock 120 (FIG. 1) can be a combination lock, instead of a key lock. Additionally, the mating of lock 120 and barrel cap 40 in FIG. 1 can be accomplished by other techniques than that illustrated in and described with reference to FIG. 1. Accordingly, the disclosure of embodiments of the invention is intended to be illustrative of the scope of the invention and is not intended to be limiting. It is intended that the scope of the invention shall be limited only to the extent required by the appended claims.

Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Furthermore, the terms "comprise," "include," "have," and any variations thereof, are intended to cover a non-exclusive inclusion, such that a process, method, article, or apparatus that comprises a list of elements does not include only those elements, but may include other elements not expressly listed or inherent to such process, method, article, or apparatus.

Moreover, embodiments and limitations disclosed herein are not dedicated to the public under the doctrine of dedication if the embodiments and/or limitations: (1) are not expressly claimed in the claims and (2) are or are potentially equivalents of express elements and/or limitations in the claims under the doctrine of equivalents.

What is claimed is:

1. A security device to secure an apparatus having a wall with a slot, the security device comprising:

a first shaft comprising:

a first arm rotatable about a first axis into and out of a first position; and a first tang extending, non-parallel to the first axis, from the first arm; and a second shaft comprising:

a second arm rotatable about a second axis into and out of a second position; and a second tang extending, non-parallel to the second axis, from the second arm, wherein:

the first axis is different from the second axis; and the second tang is approximately co-linear with the first tang when the first arm is in the first position and the second arm is in the second position;

a housing from which the first and second shafts extend;

a cam adjacent to the housing and the first and second shafts;

a lock adjacent to the housing and the cam; and a cable coupled to the housing, wherein:

the cam rotates the first and second shafts;

the cam comprises a draw-up mechanism adjacent to the housing and the first and second shafts;

the draw-up mechanism moves the first and second tangs closer to the housing; and the lock locks the first arm and the second arm.

2. The security device of claim 1 wherein:

the second tang is approximately parallel with the first tang when the first arm is devoid of being in the first position and the second arm is devoid of being in the second position.

3. The security device of claim 1 wherein:

the first axis is approximately parallel to the second axis.

4. The security device of claim 1 wherein:

the cam rotates the first shaft by less than approximately one hundred-eighty degrees about the first axis; and the cam rotates the second shaft by less than approximately one hundred-eighty degrees about the second axis.

5. The security device of claim 1 wherein:

the first shaft remains substantially devoid of rotation about the first axis while the draw-up mechanism moves the first tang; and the second shaft remains substantially devoid of rotation about the second axis while the draw-up mechanism moves the second tang.

6. The security device of claim 1 wherein:

the first shaft abuts against at least a first edge of the slot and a second edge, opposite the first edge, of the slot when the first shaft is located in the slot; and the second shaft abuts against at least the first edge and the second edge when the second shaft is located in the slot.

7. The security device of claim 1 wherein:

the first shaft further comprises:

a first extension inside the housing, contacting the cam, and extending, non-parallel to the first axis, from the first arm;

the second shaft further comprises:

a second extension inside the housing, contacting the cam, and extending, non-parallel to the second axis, from the second arm, and the first and second tangs are outside the housing.

8. The security device of claim 1 wherein:

the first and second axis are approximately parallel to each other; and the first and second tangs are approximately parallel with each other when the first arm is devoid of being in the first position and the second arm is devoid of being in the second position.

9. A security device to secure an apparatus having a wall with a slot, the security device comprising:

a housing;

a first shaft rotatable, relative to the housing, about a first axis from a first position to a second position, the first shaft comprising:

a first arm extending from the housing along the first axis; and a first tang outside the housing and extending from the first arm in a first direction non-parallel to and non-co-linear with the first axis;

a second shaft rotatable, relative to the housing, about a second axis from a third position to a fourth position, the second shaft comprising:

a second arm extending from the housing along the second axis; and a second tang outside the housing and extending from the second arm in a second direction non-parallel to and non-co-linear with the second axis;

a lock adjacent to the housing to lock the first shaft and the second shaft, wherein:

the first axis is approximately parallel to the second axis;

the first tang is approximately co-linear with the second tang when the first shaft is in the first position and the second shaft is in the third position; and the first tang is approximately parallel with the second tang when the first shaft is in the second position and the second shaft is in the fourth position; and a cam adjacent to the housing and the first and second shafts, the cam comprising a draw-up mechanism adjacent to the housing and the first and second shafts;

wherein:

the cam rotates the first shaft by approximately ninety degrees about the first axis;

the cam rotates the second shaft by approximately ninety degrees about the second axis;

the draw-up mechanism moves the first arm along the first axis and moves the first tang closer to the housing after the cam rotates the first shaft by approximately ninety degrees about the first axis; and the draw-up mechanism moves the second arm along the second axis and moves the second tang closer to the housing after the cam rotates the second shaft approximately ninety degrees about the second axis.

10. The security device of claim 9 wherein:

the cam simultaneously rotates the first and second shafts in a clockwise direction.

11. The security device of claim 9 wherein:

the first shaft remains devoid of rotation about the first axis while the draw-up mechanism moves the first tang closer to the housing; and the second shaft remains devoid of rotation about the second axis while the draw-up mechanism moves the second tang closer to the housing.

12. The security device of claim 9 wherein:

the first shaft is in the first position when the second shaft is in the third position;

the first arm and the first tang are capable of being inserted into and removed from the slot when the first shaft is in the first position; and the second arm and the second tang are capable of being inserted in and removed from the slot when the second shaft is in the third position.

13. The security device of claim 12 wherein:

the first shaft is in the second position when the second shaft is in the fourth position;

when the first arm is located in the slot and when the first shaft is in the second position, the first arm and the first tang are immovable from the slot; and when the second arm is located in the slot and when the second shaft is in the fourth position, the second arm and the second tang are immovable from the slot.

14. The security device of claim 9 wherein:

the first arm abuts against at least a first edge of the slot and a second edge, opposite the first edge, of the slot when the first arm is located in the slot;

the second arm abuts against at least the first edge and the second edge when the second arm is located in the slot;

the first tang abuts against a first portion of the wall adjacent to the first edge when the first arm is located in the slot; and the second tang abuts against a second portion of the wall adjacent to the second edge when the second arm is located in the slot.

15. A security device to secure an apparatus having a wall with a slot, the security device comprising:

a housing;

a first shaft rotatable, relative to the housing, about a first axis from a first position to a second position, the first shaft comprising:

a first arm extending from the housing along the first axis; and a first tang outside the housing and extending from the first arm in a first direction non-parallel to and non-co-linear with the first axis;

a second shaft rotatable, relative to the housing, about a second axis from a third position to a fourth position, the second shaft comprising:

a second arm extending from the housing along the second axis; and a second tang outside the housing and extending from the second arm in a second direction non-parallel to and non-co-linear with the second axis;

a lock adjacent to the housing to lock the first shaft and the second shaft, wherein:

the first axis is approximately parallel to the second axis;

the first tang is approximately co-linear with the second tang when the first shaft is in the first position and the second shaft is in the third position; and the first tang is approximately parallel with the second tang when the first shaft is in the second position and the second shaft is in the fourth position; and a cam adjacent to the housing, the lock, and the first and second shafts; and a cable coupled to the housing, wherein:

the cam rotates the first shaft by less than approximately one hundred-eighty degrees about the first axis;

the cam rotates the second shaft by less than approximately one hundred-eighty degrees about the second axis;

the cam comprises a draw-up mechanism adjacent to the housing and the first and second shafts, the draw-up mechanism moves the first tang along the first axis and closer to the housing; and the draw-up mechanism moves the second tang along the second axis and closer to the housing.

16. The security device of claim 15 wherein:

the first shaft further comprises:

a first extension inside the housing and extending from the first arm in a third direction non-parallel to and non-co-linear with the first axis;

the second shaft further comprises:

a second extension inside the housing and extending from the second arm in a fourth direction non-parallel to and non-co-linear with the second axis;

the first, second, third, and fourth directions are different from each other when the first shaft is in the first position and when the second shaft is in the third position;

the draw-up mechanism moves the first tang along the first axis and closer to the housing after the first shaft is rotated less than one hundred eighty degrees; and the draw-up mechanism moves the second tang along the second axis and closer to the housing after the second shaft is rotated less than one hundred eighty degrees.

17. The security device of claim 15 wherein:

the first shaft is in the first position when the second shaft is in the third position;

the first arm and the first tang are capable of being inserted into and removed from the slot when the first shaft is in the first position; and the second arm and the second tang are capable of being inserted in and removed from the slot when the second shaft is in the third position.

18. The security device of claim 15 wherein:

the first arm abuts against at least a first edge of the slot and a second edge, opposite the first edge, of the slot when the first arm is located in the slot;

the second arm abuts against at least the first edge and the second edge when the second arm is located in the slot;

the first tang abuts against a first portion of the wall adjacent to the first edge when the first arm is located in the slot; and the second tang abuts against a second portion of the wall adjacent to the second edge when the second arm is located in the slot.

19. A method of manufacturing a security device for securing an apparatus having a wall with a slot, the method comprising:

providing a housing;

providing a first shaft comprising:

a first arm having a first axis; and a first tang extending, non-parallel to the first axis, from the first arm;

providing a second shaft comprising:

a second arm having a second axis; and a second tang extending, non-parallel to the second axis, from the second arm;

providing a draw-up mechanism; and assembling the draw-up mechanism with the first and second shafts;

assembling the first and second shafts in the housing;

wherein:

the first arm extends from the housing and is rotatable about the first axis into and out of a first position;

the second arm extends from the housing and is rotatable about the second axis into and out of a second position;

the first axis is different from the second axis;

the second tang is approximately co-linear with the first tang when the first arm is in the first position and the second arm is in the second position; and the draw-up mechanism moves the first and second tangs closer to the housing.

20. The method of claim 19 further comprising:

providing a cam; and assembling the cam with the first and second shafts, wherein:

the cam rotates the first and second shafts.

21. The method of claim 20 further comprising:

providing a lock; and assembling the lock with the cam, wherein:

the lock locks the first arm and locks the second arm.

22. The method of claim 19 further comprising:

providing a cable; and assembling the cable with the housing.

23. A security device to secure an apparatus having a wall with a slot, the security device comprising:

a housing;

a first shaft extending out of the housing and comprising:

a first arm rotatable about a first axis; and a first tang extending, non-parallel to the first axis, from the first arm;

a second shaft extending out of the housing and comprising:

a second arm rotatable about a second axis; and a second tang extending, non-parallel to the second axis, from the second arm, and a draw-up mechanism adjacent to the housing and the first and second shafts, wherein:

the first axis is different from the second axis; and the draw-up mechanism moves the first and second tangs closer to the housing.

* * * * *